United States Patent [19]

Hanert

[11] Patent Number: 4,598,891

[45] Date of Patent: Jul. 8, 1986

[54] CLOSET ROD RACKET AND BALL HOLDER

[76] Inventor: John A. Hanert, 1678 Central Ave., Deerfield, Ill. 60015

[21] Appl. No.: 685,444

[22] Filed: Dec. 24, 1984

[51] Int. Cl.[4] ..... A47F 7/00

[52] U.S. Cl. ..... 248/340; 248/153; 248/302; 211/14; 211/119

[58] Field of Search ..... 248/340, 302, 153, 317; 211/14, 13, 119, 206; 273/74, 73 R

[56] References Cited

U.S. PATENT DOCUMENTS

| | | | |
|---|---|---|---|
| 1,289,086 | 12/1918 | Baumann | 248/302 |
| 2,222,831 | 11/1940 | Bitney | 211/106 |
| 2,461,178 | 2/1949 | Reinke | 211/106 |
| 2,491,515 | 12/1949 | Orchard | 248/302 |
| 2,499,188 | 2/1950 | Freeman | 248/340 |
| 2,609,937 | 9/1952 | Rubenstein | 211/106 |
| 3,265,246 | 8/1966 | Messenger | 211/119 |
| 3,486,630 | 12/1969 | Ellman | 211/13 |
| 3,789,996 | 2/1974 | Stroh | 211/119 |
| 3,923,162 | 12/1975 | Hussey | 248/302 |
| 4,106,736 | 8/1978 | Becker | 248/302 |
| 4,116,340 | 9/1978 | Nelson | 211/13 |
| 4,241,836 | 12/1980 | Cousins | 211/14 |
| 4,387,811 | 6/1983 | Ragir | 211/119 |

FOREIGN PATENT DOCUMENTS

| | | | |
|---|---|---|---|
| 56778 | 10/1939 | Denmark | 211/106 |

*Primary Examiner*—Reinaldo P. Machado
*Assistant Examiner*—A. Chin-Shue
*Attorney, Agent, or Firm*—Douglas B. White

[57] ABSTRACT

There is provided a racket and ball or container supporting device generally comprising a suspension member formed of a wire framework and arranged to be suspended at one end from a wire hook for placement about a closet rod, hook, or other support. For supporting the rackets from this suspension member there is provided in the preferred embodiment a loop or prongs which project upwardly from the bottom of the suspension member forming an acute angle with the suspension member. For supporting the balls or containers there is generally provided an enclosure member similarly formed as a loop and having protruding downwardly therefrom a supporting member affixed to the sides thereof.

6 Claims, 5 Drawing Figures

CLOSET ROD RACKET AND BALL HOLDER

BACKGROUND OF THE INVENTION

1. Field of the Invention

The present invention relates generally to devices designed to hold or store personal objects suspended from a hook or rod. More particularly, this invention relates to a device for storing a racket, such as a tennis racket, and related equipment, such as balls or containers of balls, suspended from a hook or rod.

2. Description of the Prior Art

Prior devices for suspending wearing apparel have been known in the art. In particular, U.S. Pat. No. 2,598,315, issued to Arthur Sweet, discloses a modified coat hanger designed to suspend ties. This tie rack, when suspended from a hook along the side of a closet, maintains the tie supporting portion away from the wall for easy access. In another related suspension device, U.S. Pat. No. 2,078,613, issued to James Sieber, there is provided an extension of the traditional coat hanger. A basket is attached to the lower portion of the coat hanger by suspending bars, and within the frame formed by the coat hanger and the suspending bars there are provided a plurality of hooks. In yet another improvement in the art, U.S. Pat. No. 4,422,556, issued to J. T. Moore, a wire basket receptacle is suspended by a wire frame on supporting protrusions therefrom and further provides hooks projecting underneath for hanging clothes.

The storage of rackets and balls from tennis or raquetball has long posed a problem. The rackets do not stand up neatly against a wall and balls, even if in containers, tend to roll about. As a result, storage of these items has been difficult. No devices for suspending and storing both rackets and balls are known to Applicant. In the tennis racket art, patents have been issued for other storage devices for storing tennis balls on tennis rackets. More particularly, in the U.S. Pat. No. 4,002,337, issued to Donald Rayfield, a device is provided for supporting a ball container from a tennis racket handle. There a wrap-around member surrounds a can of tennis balls and proceeds to wrap around the handle of the tennis racket, and finally is secured to itself to hold the can firmly to the tennis racket handle. In U.S. Pat. No. 4,007,930, issued to Albert Straus, a tennis racket clamp or racket press is provided which also includes an enclosure receptacle for tennis balls.

In contrast to the above, in the preferred embodiment of the present invention, there is provided means for suspending tennis, raquetball, or badminton rackets and balls or containers of balls or shuttlecocks in convenient proximity. This is accomplished by generally providing a suspension member having projecting on one side thereof a loop member through which the racket handles, projecting in a downwardly direction, are placed and on which the racket head is supported. On the other side of the suspension member, there is generally provided a combined encompassing enclosure member and an attached support member for supporting and holding balls or containers.

SUMMARY OF THE INVENTION

The racket and ball or container supporting device of the present invention generally comprises a first suspension member formed of a wire framework and arranged to be suspended at one end from a wire hook for placement about a closet rod, hook, or other support. For supporting the rackets from this suspension member there is provided a projecting loop or prongs which in the preferred embodiment project upwardly forming an acute angle with the suspension member. For supporting the balls or canisters there is generally provided an enclosure member similarly formed as a loop and having protruding downwardly therefrom a supporting member rigidly affixed to the sides of the enclosure member.

Other objects and advantages of the invention will become apparent upon reading the following detailed description and upon reference to the drawings, in which.

While the invention will be described in connection with the preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
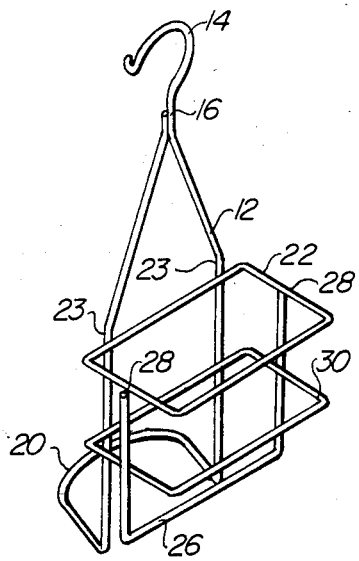
FIG. 1 is a pictorial view of the racket and ball or container suspension and storage device of the present invention.
Figure 5:
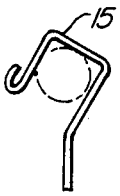
FIG. 5 is a front view of an alternative embodiment of the suspending hook of the device of FIG. 1.

Turning now to FIG. 1 there is shown the racket and ball or container suspension device of the present invention having a suspension member 12 arranged for suspension from an upper hook member 14 designed to engage a suspending rod or hook. This upper hook member may within the scope of the invention also take an angled form as shown in FIG. 5 and indicated by numeral 15. This alternate embodiment of the hook assists centering the device upon the closet rod to maintain the suspension device perpendicular to the rod. Upon twisting of the suspension device, the hook is caused to climb up the rod periphery while maintaining contact at the two supporting points of the hook. Consequently, the suspension device will, due to gravity, seek its lowest position and will come to rest perpendicular to the rod and neatly aligned within the closet. A further embodiment may also include an expanded wide curved or angled hook for accomplishing the same function.

The suspension member, generally made up of parallel vertical wire members, converges to a central point of attachment 16 to the hook member. These dual arms of the suspension member protrude to the bottom-most extension of the device where they are affixed to the racket supporting member 20.

In the preferred embodiment of the present invention, this racket supporting member comprises a loop generally formed as extensions of the suspension member. This loop is designed to project outwardly from the suspension member and to form a cradle in which to support rackets. As an alternate embodiment, the racket supporting member may be comprised of two outwardly and upwardly protruding prongs (not shown) affixed each to the lower portion of the dual arms of the suspension member. With this embodiment, a racket may be placed into storage without the necessity of inserting the racket handle through a closed loop.

Figure 3:
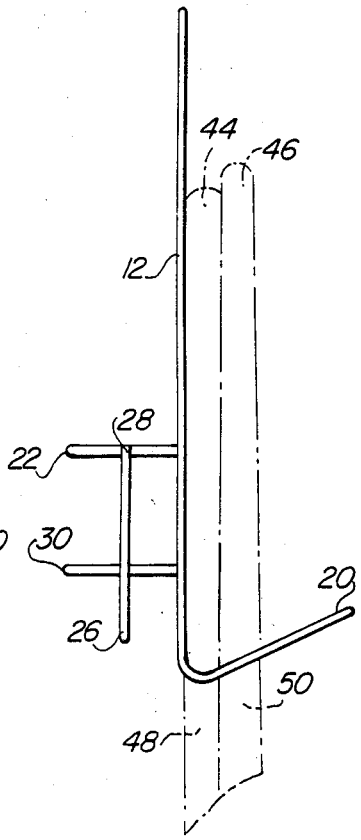
FIG. 3 is a side view of the device of FIG. 1 showing the rackets in storage position.
Figure 4:
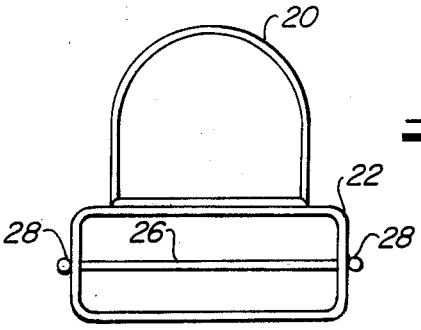
FIG. 4 is a plan view of the device of FIG. 1.

Turning now to FIG. 3 there is shown in dotted lines the placement of rackets 44 and 46 showing placement of their handles 48 and 50 through the racket supporting loop 20. In the preferred embodiment, the loop projects upwardly and forms an acute angle with the suspension member. The angle of the member causes a racket inserted in the racket suspension member to rest at the lowest available position and maintains multiple rackets in close proximity while stored.

Figure 2:
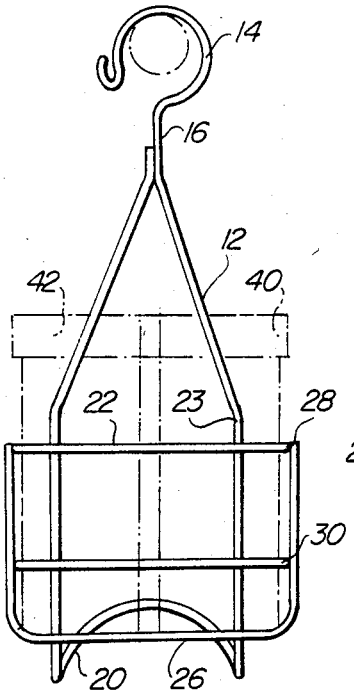
FIG. 2 is a front view of the device of FIG. 1 showing ball containers in dotted outline.

The portion of this device arranged to hold and support equipment such as balls or containers of balls or shuttlecocks is generally configured of a first encompassing member 22 rigidly affixed to the suspension members at 23 and arranged to provide lateral support to the balls or containers when placed therein. Projecting downwardly from this enclosure member is a support member 26 rigidly affixed to the enclosure member 22 generally at the midpoint 28 of its side. For further enclosing the balls or containers and preventing slip from the container supporting member 26 there is provided a second enclosure member 30 similarly rigidly affixed to the suspension members and to the container support member. A front view of the racket and ball suspension device of the present invention is depicted in FIG. 2 showing ball containers 40 and 42 in dotted lines located within the enclosure members and supported by the lower support member.

I claim:

1. A device for supporting a racket and balls and arranged for suspension from a closet rod or the like comprising:

a suspension member arranged to be suspended from one end thereof;

racket support means affixed to the other end and at one side of said suspension member for supporting a plurality of rackets; and ball support means affixed to an opposite side of said suspension member and arranged with respect to said racket support means to provide balance about said suspension member when said device is supporting rackets and balls by their respective support means, whereby said rackets are maintained in a substantially vertical alignment; said racket support means comprises a substantially rigid loop projecting from said suspension member and forming an acute angle therewith.

2. The device of claim 1 wherein said ball support means comprises an enclosure member affixed to said suspension member and arranged to encompass balls, and a supporting member affixed to said enclosure member for providing support to the balls,

3. The device of claim 2 wherein said ball support means and said racket support means are affixed to the suspension member and arranged on opposite sides of a defined plane positioned perpendicularly to the closet rod.

4. The device of claim 3 wherein said ball support means is positioned in juxtaposition with said racket support means.

5. The device of claim 4 further comprising a hook affixed to said suspension member and arranged for suspension of the device therefrom.

6. The device of claim 5 wherein said hook comprises multiple substantially straight joined rigid members affixed to the suspension member at one end thereof, whereby said hook makes contact with the rod at a plurality of points.

* * * * *